US009482008B2

(12) United States Patent
Iannelli

(10) Patent No.: US 9,482,008 B2
(45) Date of Patent: Nov. 1, 2016

(54) HEATED GUTTER COVER SYSTEM

(71) Applicant: Anthony M. Iannelli, Cincinnati, OH (US)

(72) Inventor: Anthony M. Iannelli, Cincinnati, OH (US)

( * ) Notice: Subject to any disclaimer, the term of this patent is extended or adjusted under 35 U.S.C. 154(b) by 0 days.

(21) Appl. No.: 14/876,015

(22) Filed: Oct. 6, 2015

(65) Prior Publication Data

US 2016/0024797 A1 Jan. 28, 2016

Related U.S. Application Data

(62) Division of application No. 14/039,318, filed on Sep. 27, 2013, now Pat. No. 9,181,707.

(60) Provisional application No. 61/706,805, filed on Sep. 28, 2012.

(51) Int. Cl.

| | |
|---|---|
| ***E04D 13/076*** | (2006.01) |
| ***E04D 13/064*** | (2006.01) |
| ***H05B 3/00*** | (2006.01) |
| ***H05B 3/56*** | (2006.01) |

(52) U.S. Cl.

CPC ..... *E04D 13/0762* (2013.01); *E04D 13/064* (2013.01); *H05B 3/0014* (2013.01); *H05B 3/56* (2013.01)

(58) Field of Classification Search

CPC ..... E04D 13/076; E04D 13/0761; E04D 13/0762

USPC ..... 52/12

See application file for complete search history.

(56) References Cited

U.S. PATENT DOCUMENTS

| | | | | |
|---|---|---|---|---|
| 3,725,638 | A | 4/1973 | Solin et al. | |
| 4,308,696 | A | 1/1982 | Schroeder | |
| 4,769,526 | A * | 9/1988 | Taouil | E04D 13/103 219/213 |
| 5,391,858 | A | 2/1995 | Tourangeau et al. | |
| 5,878,533 | A | 3/1999 | Swanfeld, Jr. | |
| 6,367,743 | B1 | 4/2002 | Iannelli | |
| 6,708,452 | B1 | 3/2004 | Tenute | |
| 6,759,630 | B1 | 7/2004 | Tenute | |
| 6,959,512 | B2 | 11/2005 | Cobb | |
| 6,978,577 | B2 | 12/2005 | Jones | |
| 7,051,480 | B1 | 5/2006 | Dennis | |
| 7,071,446 | B1 | 7/2006 | Bench | |

(Continued)

FOREIGN PATENT DOCUMENTS

| | | |
|---|---|---|
| CA | 2686999 | 6/2010 |

OTHER PUBLICATIONS

International Search Report and Written Opinion dated Jan. 3, 2014 for Application No. PCT/US2013/062217.

(Continued)

*Primary Examiner* — Patrick Maestri

(74) *Attorney, Agent, or Firm* — Frost Brown Todd LLC

(57) ABSTRACT

A gutter cover heater (30) for a gutter cover comprises a shield (31), a base plate (32), and a heat cable (33). The shield (31) is a longitudinally extended sheet that covers the heat cable (33), is curved over the heat cable (33), has apertures (34), a first long edge (35), and a second long edge (36). The base plate (32) is a flat longitudinally extended sheet under the heat cable (33) and the shield (31), with a first long edge (37) and a second long edge (38); wherein the first long edge of the base plate (35) is debossed. The first long edge (35) of the shield wraps under the debossing of the first long edge of the base plate (35).

6 Claims, 10 Drawing Sheets

(56) References Cited

U.S. PATENT DOCUMENTS

| | | | | |
|---|---|---|---|---|
| 7,104,012 | B1 | 9/2006 | Bayram | |
| 7,627,991 | B1 | 12/2009 | Feldhaus | |
| 7,861,980 | B1 | 1/2011 | Verbrugge et al. | |
| 7,950,187 | B2 | 5/2011 | Iannelli | |
| 8,079,183 | B2 | 12/2011 | Lenney | |
| 8,397,435 | B2 | 3/2013 | Iannelli | |
| 8,490,336 | B2 | 7/2013 | Nark | |
| 8,646,218 | B1 | 2/2014 | Iannelli | |
| 8,967,554 | B2 | 3/2015 | Gramling | |
| 9,045,907 | B2 * | 6/2015 | Clark | E04D 13/103 |
| 9,181,707 | B2 | 11/2015 | Iannelli | |
| 2010/0024324 | A1 | 2/2010 | Meinzer | |
| 2010/0287846 | A1 * | 11/2010 | Lenney | E04D 13/0762 52/12 |

OTHER PUBLICATIONS

U.S. Appl. No. 61/706,805, filed Sep. 28, 2012.

* cited by examiner

HEATED GUTTER COVER SYSTEM

CROSS REFERENCE TO RELATED APPLICATIONS

The present application hereby claims the benefit of non-provisional patent application of the same title, Ser. No. 14/039,318, filed on Sep. 27, 2013, and the provisional patent application of the same title, Ser. No. 61/706,805, filed on Sep. 28, 2012, the disclosures of which are incorporated by reference herein in their entirety.

BACKGROUND

During periods of cold weather, it is common for significant amounts of ice and snow to build up on a roof. The ice and snow can also accumulate on gutter covers, which may damage the cover or the gutter. The ice and snow on the roof, gutter covers, or both can create a "dam" effect causing melted water to flow back under the shingles and through the roof causing water damage to the roof and the interior of the house or building.

BRIEF SUMMARY

A gutter cover heater (20 or 40) may be used on a gutter cover (10), wherein the gutter cover heater (20 or 40) comprises a shield (21) and a heat cable (22). The gutter cover (10) comprises a top portion (11) extending forwardly from a rear edge (12) of the gutter cover (10). The shield (21) is a longitudinally extended sheet that covers at least a portion of the gutter cover and the heat cable (22), and is attached to the top portion (11) of the gutter cover (10).

In another embodiment, a gutter cover heater (30) for a gutter cover comprises a shield (31), a base plate (32), and a heat cable (33). The shield (31) is a longitudinally extended sheet that covers the heat cable (33), is curved over the heat cable (33), has apertures (34), a first long edge (35), and a second long edge (36). The base plate (32) is a flat longitudinally extended sheet under the heat cable (33) and the shield (31), with a first long edge (37) and a second long edge (38); wherein the first long edge of the base plate (35) is debossed. The first long edge (35) of the shield wraps under the debossing of the first long edge of the base plate (35).

These and other objects and advantages shall be made apparent from the accompanying drawings and the description thereof.

BRIEF DESCRIPTION OF THE FIGURES

The accompanying drawings, which are incorporated in and constitute a part of this specification, illustrate embodiments, and together with the general description given above, and the detailed description of the embodiments given below, serve to explain the principles of the present disclosure.

DETAILED DESCRIPTION

Figure 1A:
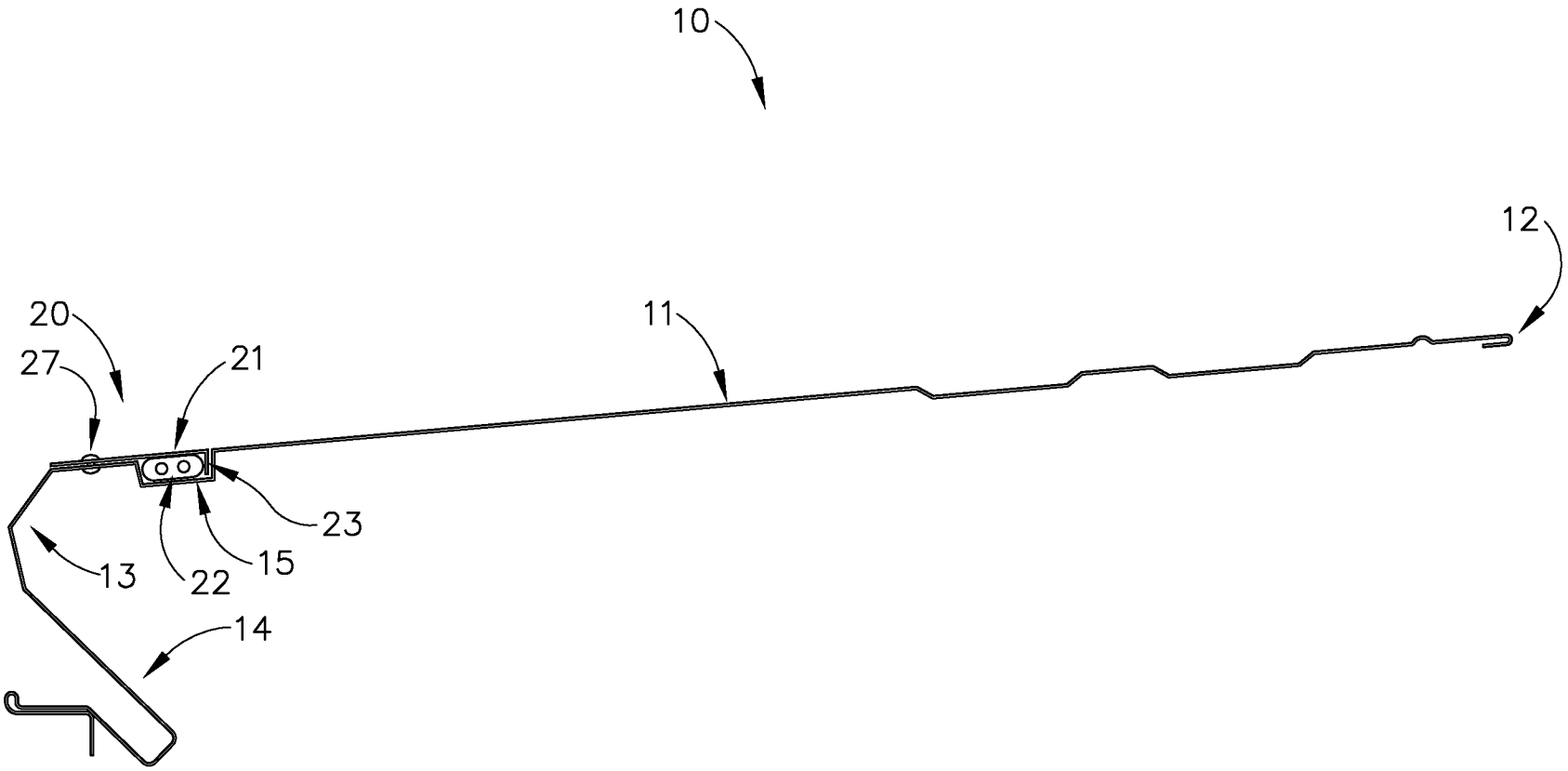
FIG. 1A is a cross-section view of an embodiment of a gutter cover with a gutter cover heater.

A gutter cover heater (20 or 40), shown in FIGS. 1 to 4, may be used on a gutter cover (10), wherein the gutter cover heater (20 or 40) comprises a shield (21) and a heat cable (22). The gutter cover (10) comprises a top portion (11) extending forwardly from a rear edge (12) of the gutter cover (10). The shield (21) is a longitudinally extended sheet that covers at least a portion of the gutter cover (10) and the heat cable (22), and is attached to the top portion (11) of the gutter cover (10).

In embodiments shown in FIGS. 1 to 4, a substantially arcuate surface (13) extends downwardly from the top portion (11). In some embodiments a downward wall (14) extends downward from the arcuate surface (13)

In embodiments shown in FIGS. 1 to 4, the shield (21) is a longitudinally extended sheet that covers at least the front part of the top portion (11) and the heat cable (22), and is attached to the top portion (11) of the gutter cover (10).

Figure 1B:
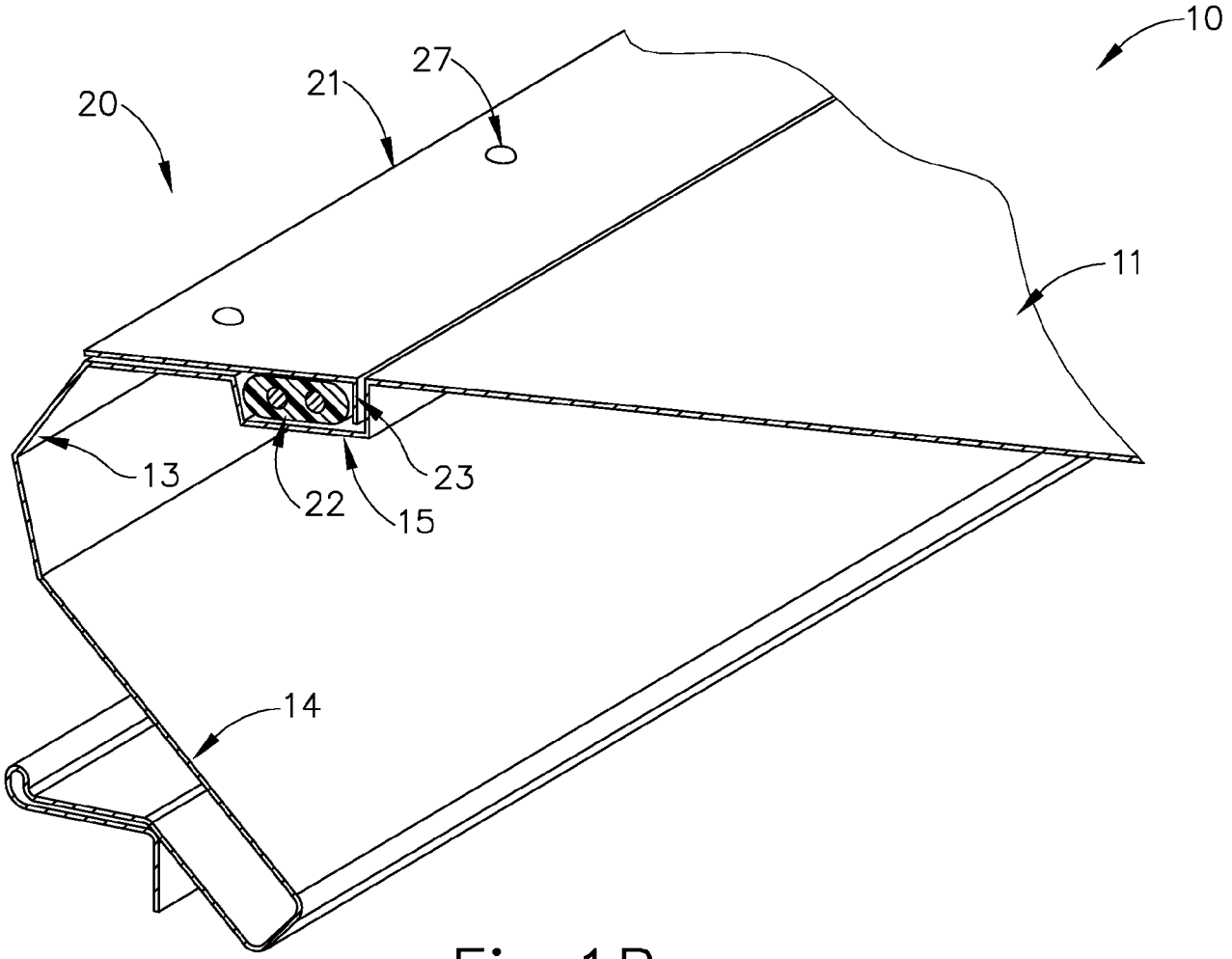
FIG. 1B is a perspective view of an embodiment of a gutter cover with a gutter cover heater.

The gutter cover (10) may have many different shapes or features. In some embodiments the gutter cover (10) is shaped as shown in FIG. 1. In another embodiment, the gutter cover is shaped as shown in U.S. Pat. Nos. 6,367,743; 7,950,187; U.S. Patent Publication No. 2011/0225898; or U.S. application Ser. No. 13/557,408; all of which are incorporated by reference in their entirety.

New Install

The gutter cover heater (20), shown in FIG. 1, comprises a specially designed gutter cover (10), that is designed to accept a heat cable (22) in a way that an existing gutter cover may not. In some embodiments the gutter cover (10) has a longitudinally extending trough (15) or debossed area in the front part of the top portion (11). In some embodiments the trough (15) is deep enough so the top of the heat cable (22) is flush or nearly flush with the top portion (11) of the gutter cover (10). The shield (21) can then cover the trough (15). In some embodiments the shield (21) is attached to the gutter cover (10) either in front of or behind the trough (15). In some embodiments the shield (21) is bent so the rear edge (23) of the shield (21) extends into the trough (15) behind the heat cable (22). The middle and front edge of the shield (21) is flush or about flush with the top portion (11) of the gutter cover (10).

In some embodiments the front of the shield (21) is attached to the front part of the top portion (11) with a fastener (27), such as a screw or a rivet.

Retrofit Install

Figure 2A:
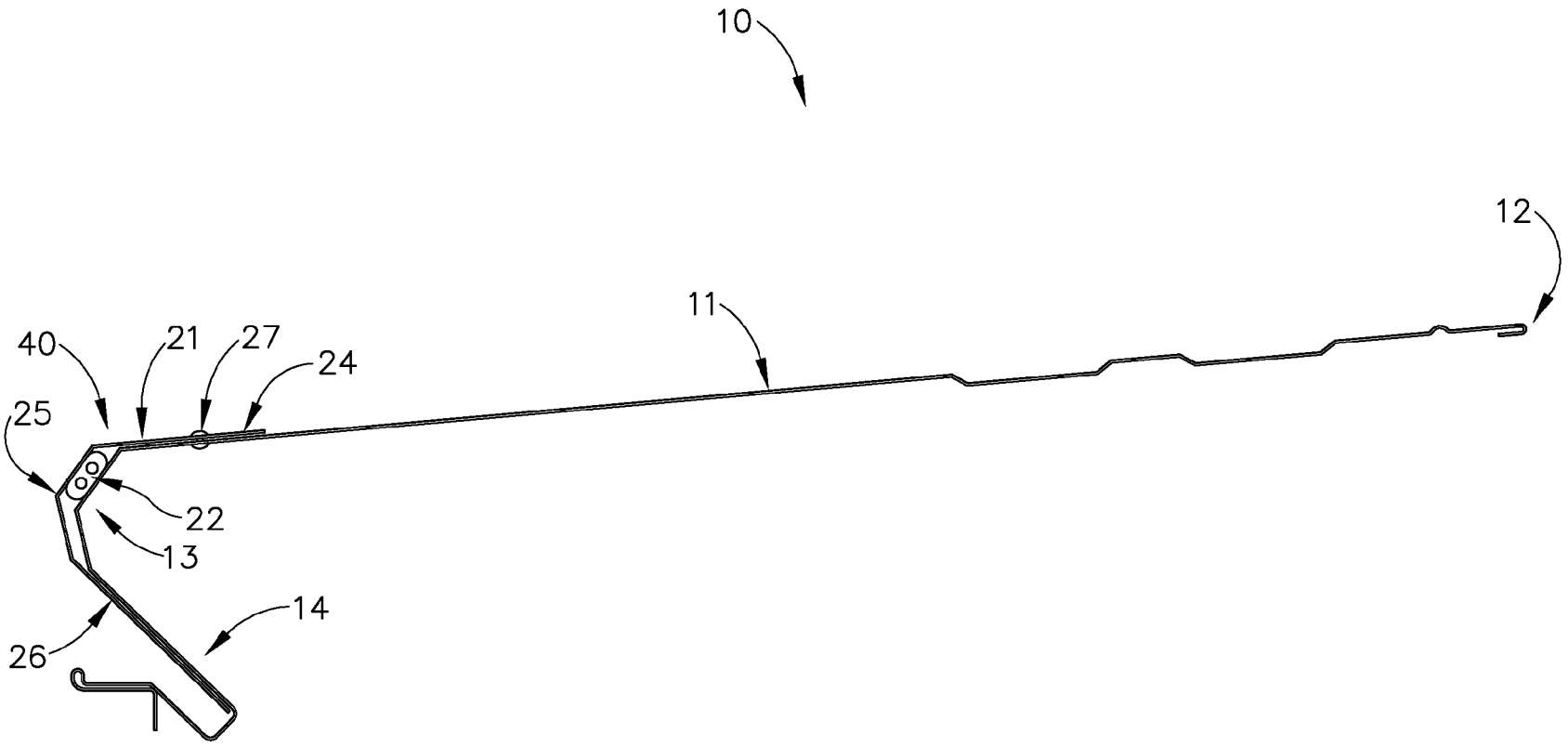
FIG. 2A is a cross-section view of an embodiment of a gutter cover with an installed gutter cover heater.
Figure 2B:
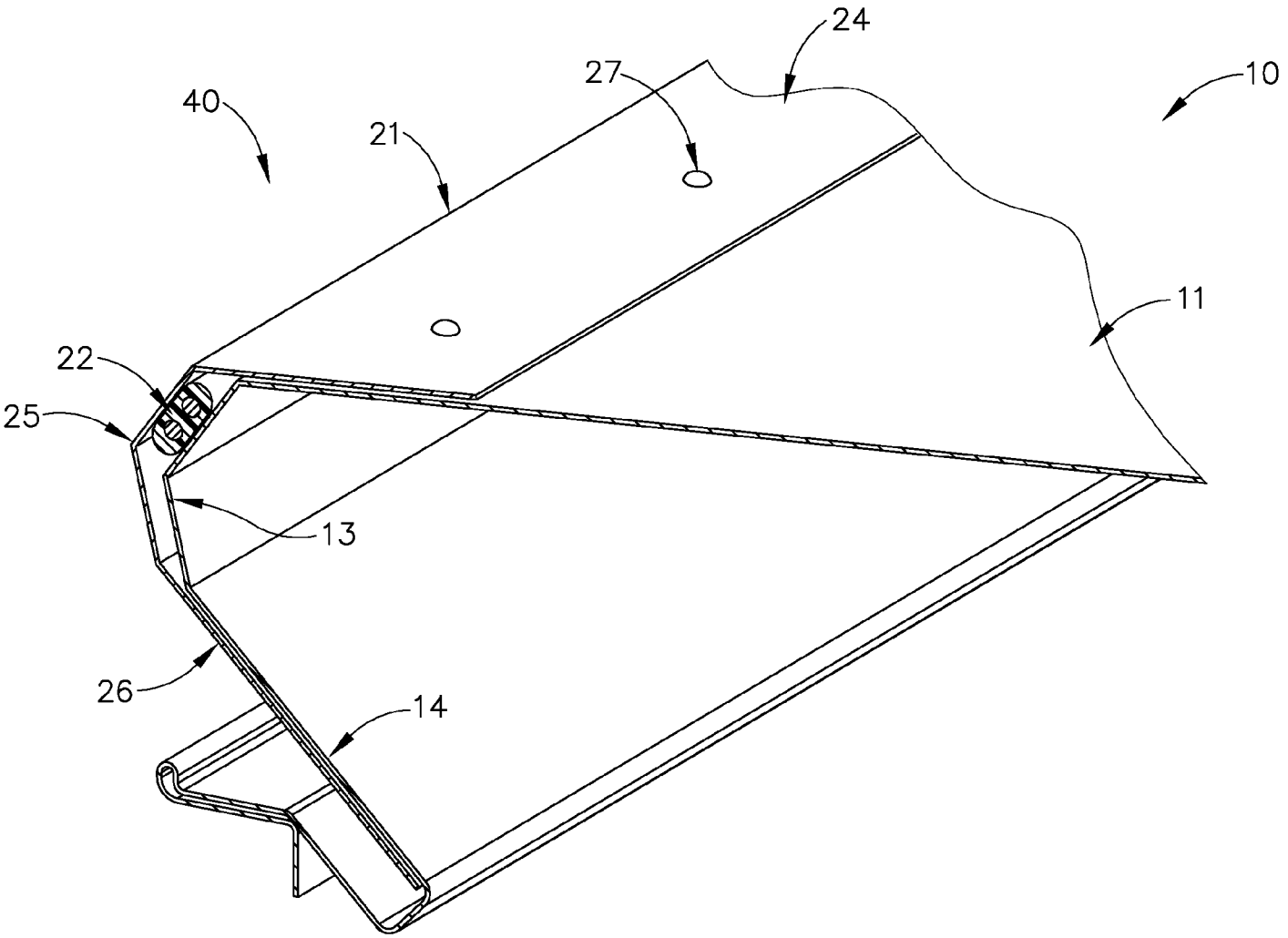
FIG. 2B is a perspective view of an embodiment of a gutter cover with an installed gutter cover heater.
Figure 3A:
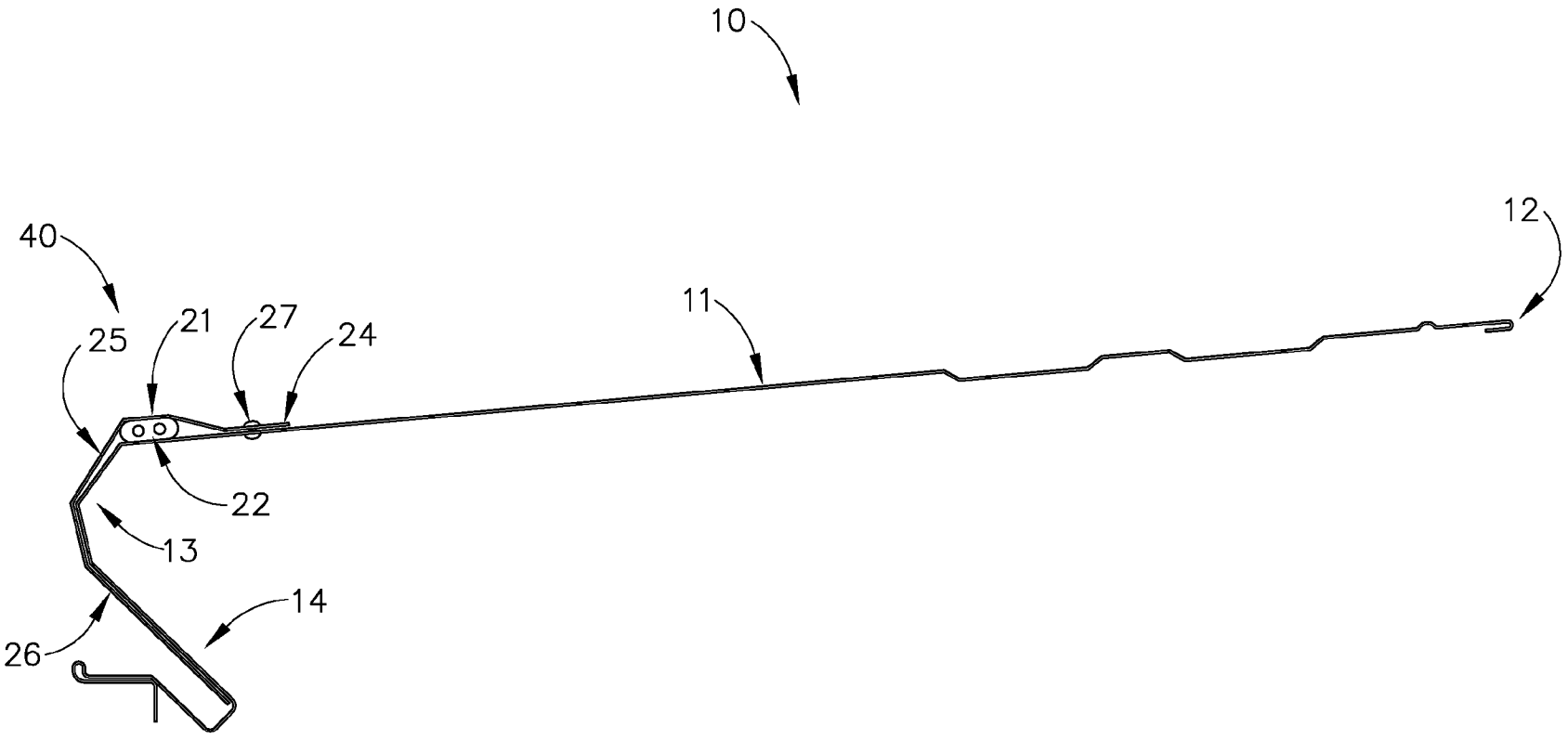
FIG. 3A is a perspective view of an embodiment of a gutter cover with an installed gutter cover heater.
Figure 3B:
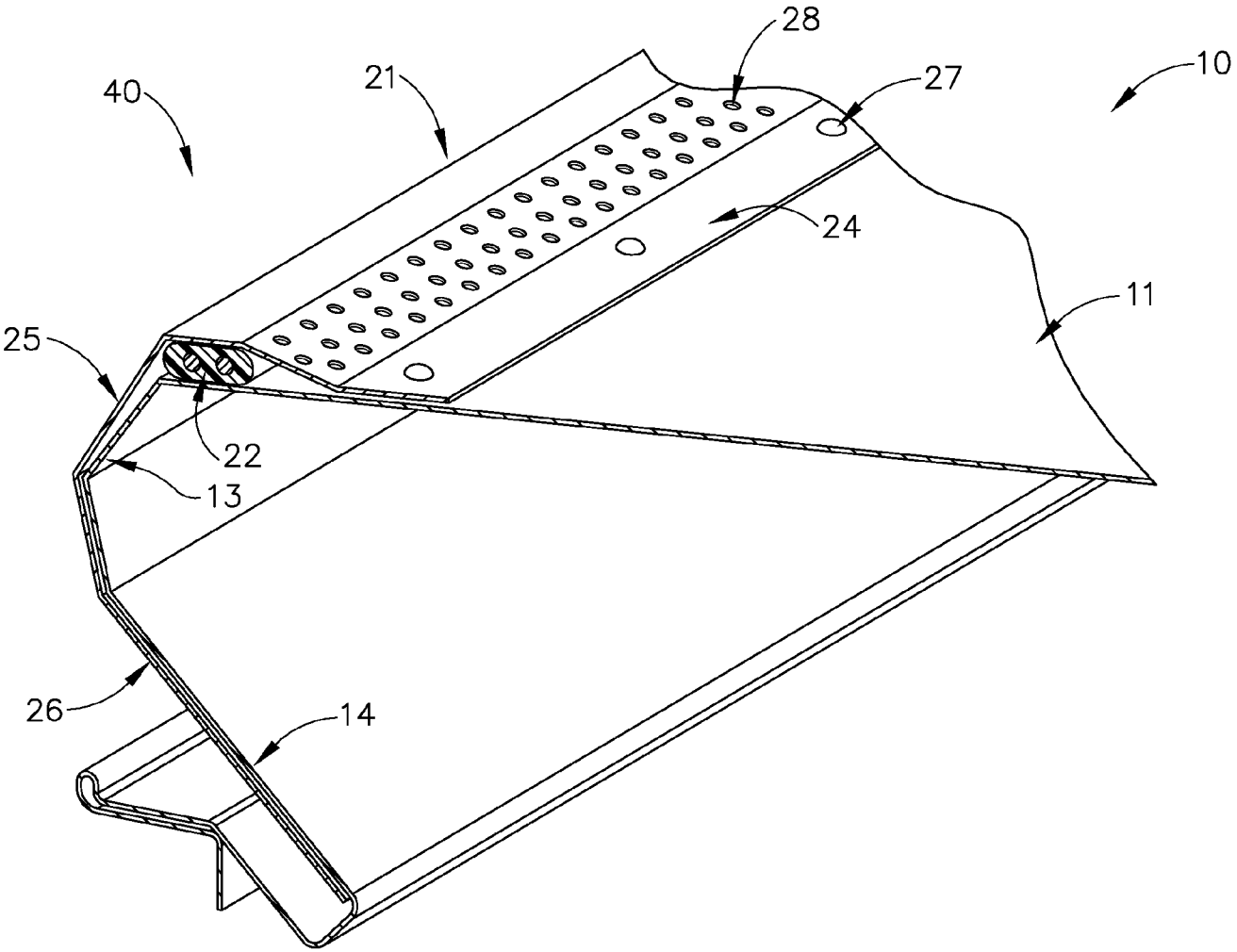
FIG. 3B is a perspective view of an embodiment of a gutter cover with an installed gutter cover heater.
Figure 4A:
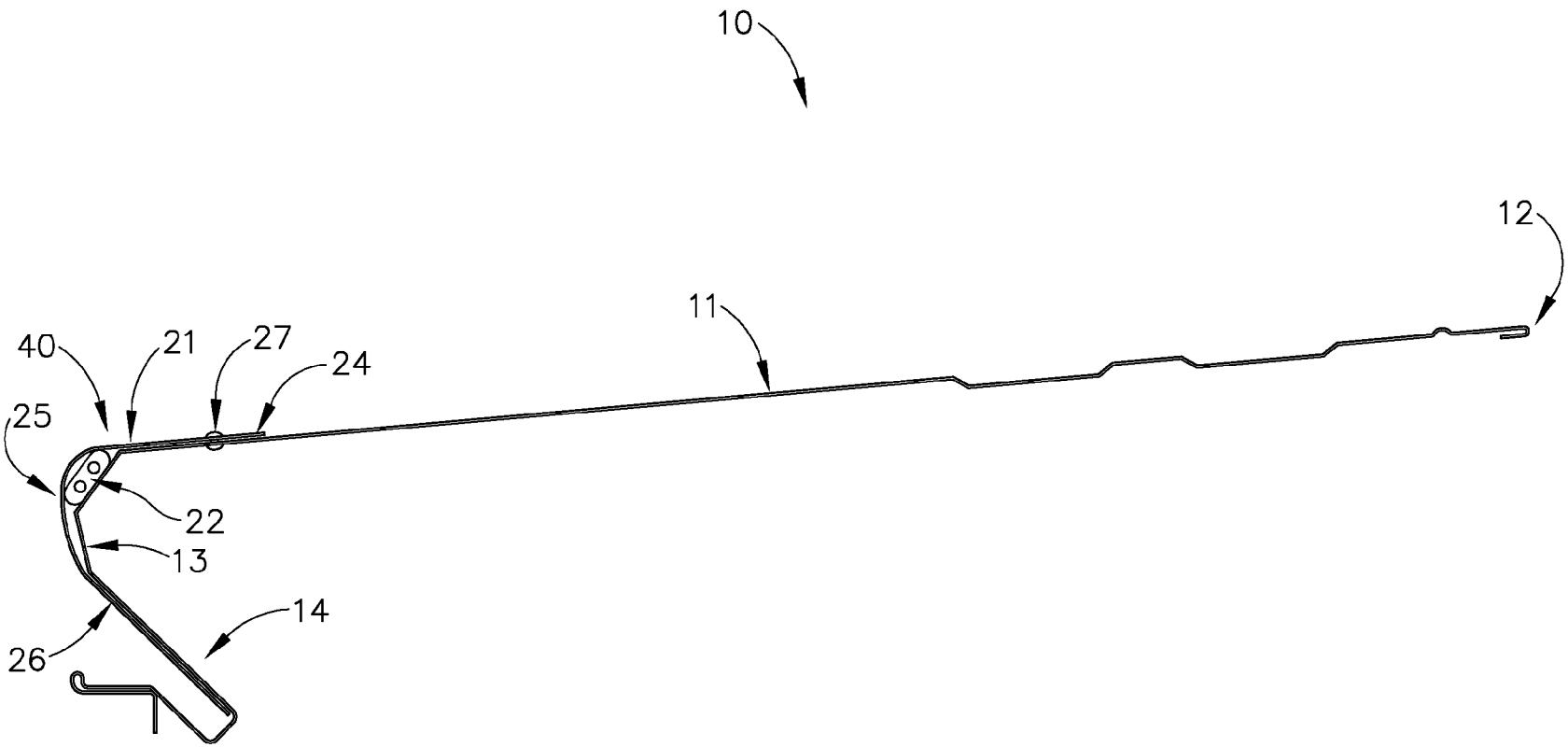
FIG. 4A is a cross-section view of an embodiment of a gutter cover with an installed gutter cover heater.
Figure 4B:
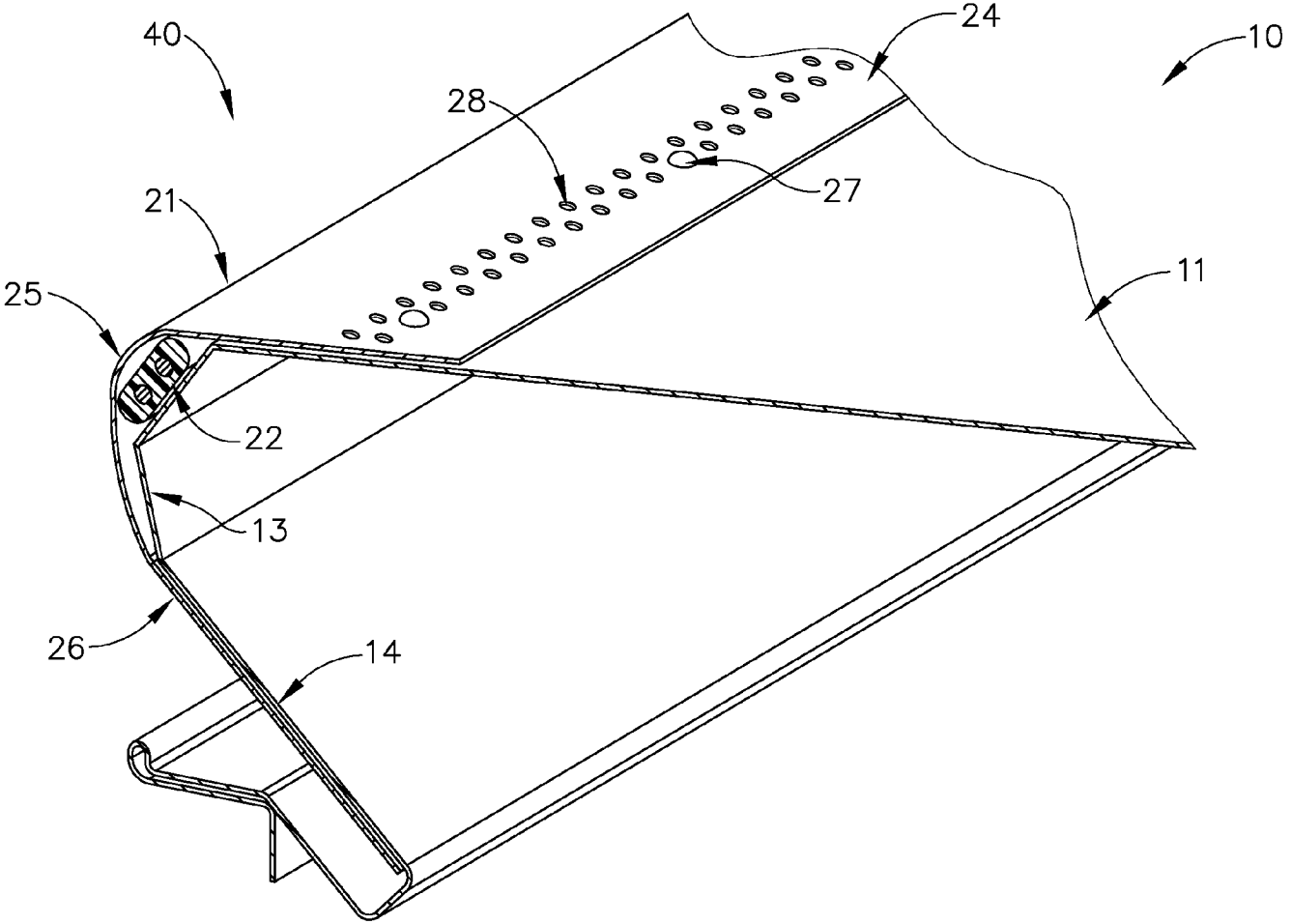
FIG. 4B is a cross-section view of an embodiment of a gutter cover with an installed gutter cover heater.

The gutter cover heaters (40), shown in FIGS. 2-4, may be used on a new installation or as a retrofit on an already existing gutter cover (10). In some embodiments, a retrofit gutter cover heater (40) can be adapted so that it can be attached to the gutter cover (10) without major modifications to the gutter or gutter cover (10). In some embodiments the heat cable (22) is located on the arcuate surface (13) of the gutter cover (10). The shield (21) covers the heat cable (22).

In embodiments shown in FIGS. 2-4, the shield is attached to the gutter cover by a spring portion. The rear (24) of the shield (21) is proximate to the front part of the top portion (11). The middle (25) of the shield (21) is bent around the heat cable (22) and the arcuate surface (13) of the gutter cover (10). The front (26) of the shield (21) is proximate to the downward wall (14). The angle of the bend in the middle (25) of the shield or spring portion is such that before the shield (21) is attached to the gutter cover (10) it forms a more acute angle between the front (26) and rear (24) part of the shield than the angle between the top portion and downward wall (14) of the gutter cover (10). This more acute angle creates a spring like tension between the front (26) and rear (24) of the shield when it is installed so it grips or puts pressure on the gutter cover (10). This allows the shield (21) to be attached to the gutter cover (10) on only one end of the shield (21).

In some embodiments the heat cable (22) is attached to the arcuate surface (13) of the gutter cover (10) with adhesive. Examples of adhesive include double sided tape and glue, which includes drying adhesives (which harden by drying), pressure sensitive adhesives, contact adhesives, hot adhesives, and multi-part adhesives.

In some embodiments the rear (24) of the shield (21) is attached to the front part of the top portion (11) with a fastener (27), such as a screw or a rivet.

In some embodiments the middle (25) part of the shield (21) has apertures (28). In some embodiments the rear part of the shield (24) has apertures (28). These apertures (28) allow rain water to flow under the shield (21) and between the shield (21) and the downward wall (14). The water drains into holes in the gutter cover (10).

The shield (21) may be bent in several different ways. In some embodiments, the shield (21) is bent around the heat cable (22) and the arcuate surface (13) as shown in FIGS. 2 to 4. The bend may be made with two or more creases, with either flat or curved portions between the creases as shown in FIGS. 2 and 3. In another embodiment the shield (21) is bent without any creases to create the bend with a smooth arcuate shape as shown in FIG. 4. The shield (21) may have a single curvature or more than one curvature, so there is more than one radii of curvature.

Retrofit with Heat Cable on Top of Gutter Cover

FIG. 3 shows an embodiment of a gutter cover heater (40) that may be used on a new installation or as a retrofit on an already existing gutter cover (10). The heat cable (22) is located on the front part of the top portion (11) behind the arcuate surface (13) of the gutter cover (10). The middle part (25) of the shield (21) is bent so that it rises from the surface of the top portion (11) to the top of the heat cable (22). The shield (21) may be bent in several different ways. In some embodiments, the shield (21) is bent around the heat cable (22) and the arcuate surface (13). The bend may be made with two or more creases, with either flat or curved portions between the creases. In another embodiment the shield (21) is bent without any creases to create the bend with a smooth arcuate shape. The shield (21) may have a single curvature or more than one curvature, so there is more than one radii of curvature.

Retrofit Install with Base Plate

Figure 5:
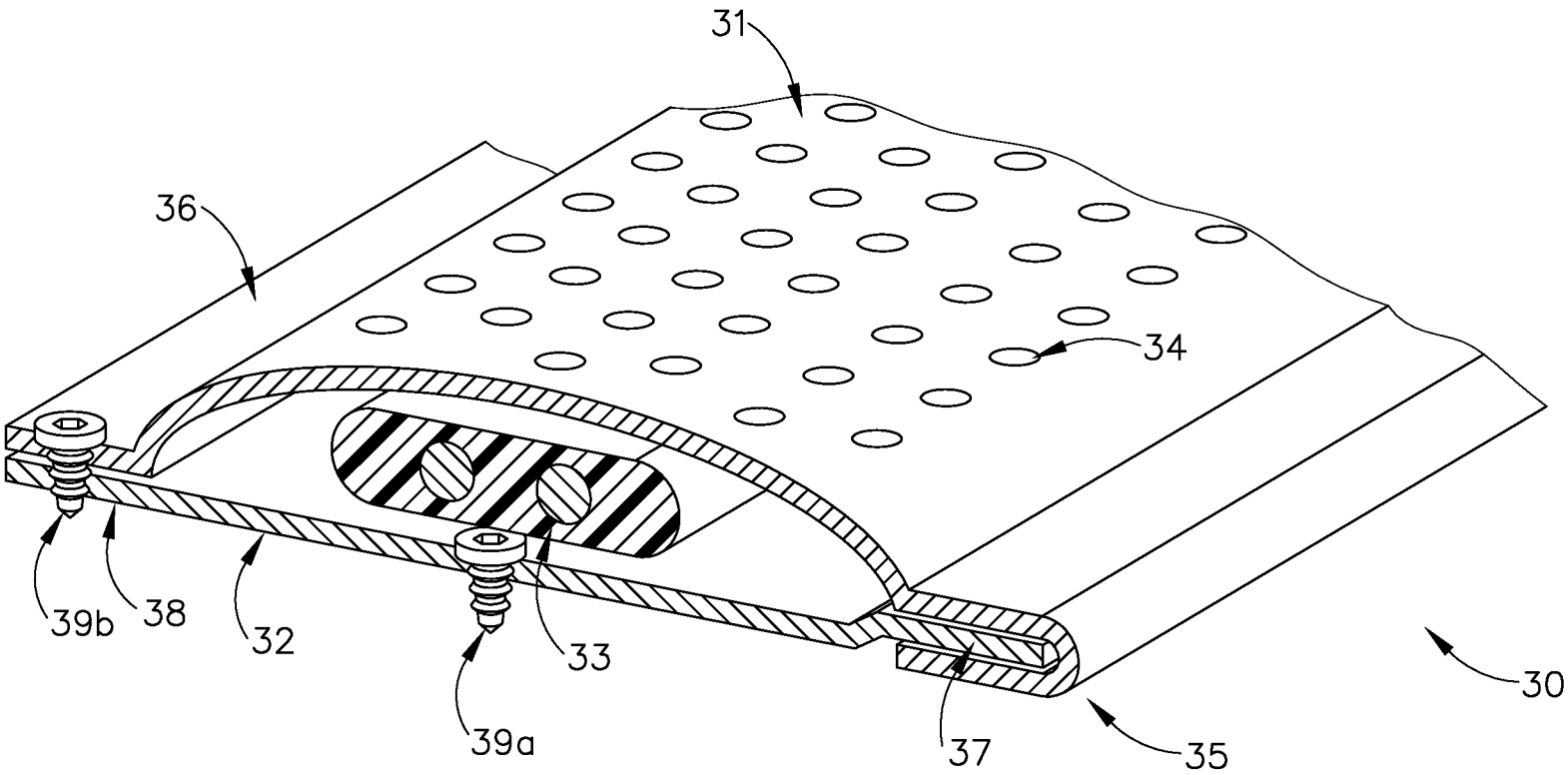
FIG. 5 is a perspective view of an embodiment of a gutter cover with an installed gutter cover heater with a base plate.
Figure 6:
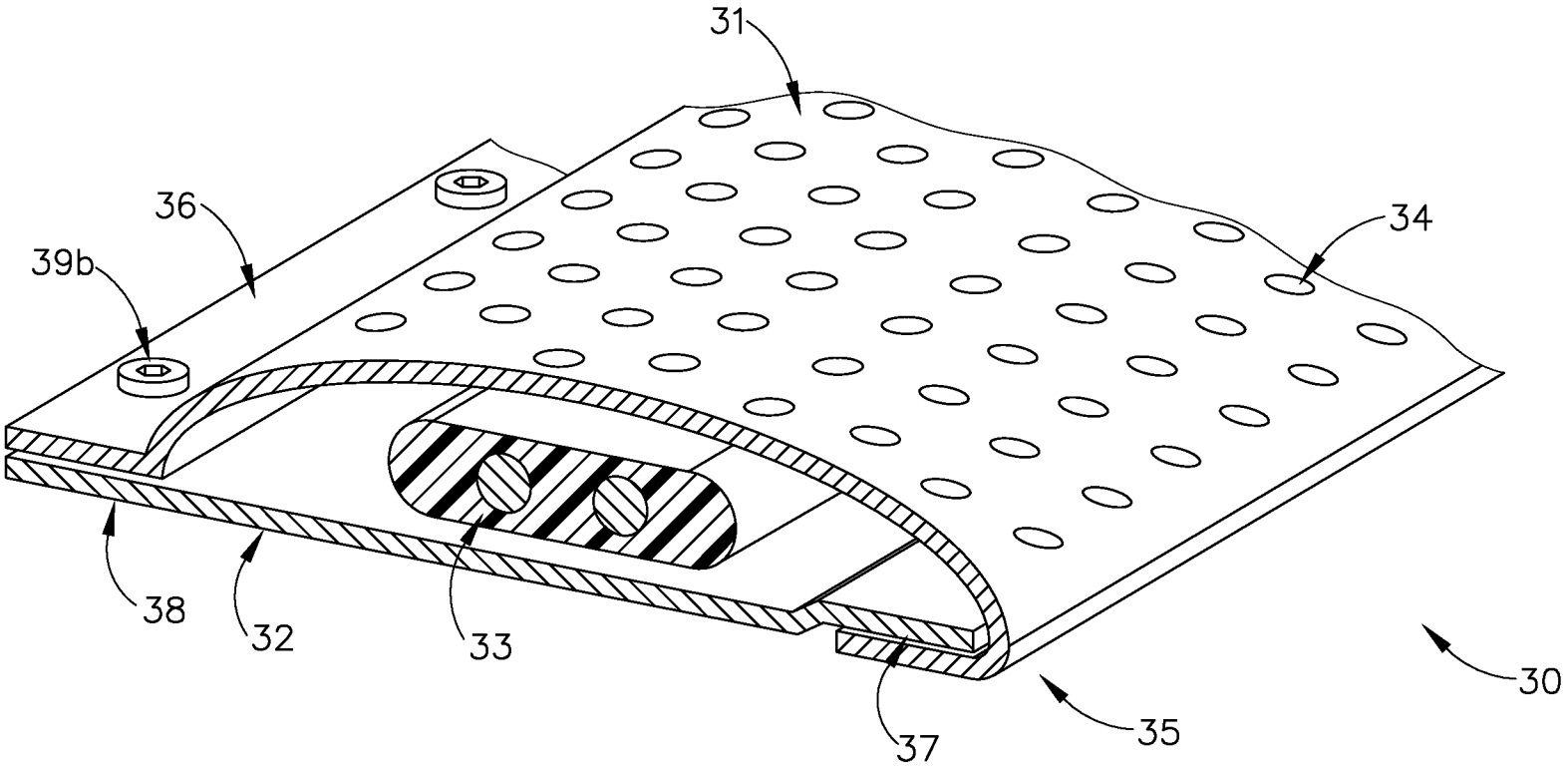
FIG. 6 is a perspective view of an embodiment of a gutter cover with an installed gutter cover heater with a base plate.

In some embodiments, a gutter cover heater (30) for a gutter cover (10) comprises a shield (31), a base plate (32), and a heat cable (33), as shown in FIGS. 5 and 6. The shield (31) is a longitudinally extended sheet that covers the heat cable (33), is curved over the heat cable (33), and has apertures (34), a first long edge (35), and a second long edge (36). The base plate (32) is a flat longitudinally extended sheet under the heat cable (33) and the shield (31), with a first long edge (37) and a second long edge (38); wherein the first long edge of the base plate (35) is debossed. The first long edge (35) of the shield (31) wraps under the debossing of the first long edge (37) of the base plate (31). The gutter cover heater (30) may be installed on any gutter cover (10) by screwing or riveting it to the gutter cover (10).

The gutter cover heater (30) may be installed by placing the base plate (32) onto a gutter cover (10) and attaching it to the gutter cover (10) with a fastener (39*a*), such as a screw or a rivet. The shield (31) is then hooked onto the debossed edge of the base plate (32). The heat cable (33) is then slid or placed under the shield (31). Because the shield (31) is hooked onto the base plate (32), it will be easier to install the heat cable (33) without it sliding off the base plate (32). Also, because one edge of the shield (31) is hooked onto the base plate (32), it is much easier to align the long edges of the shield (31) with the base plate (32). The shield (31) is then attached to the base plate (32), gutter cover (10), or both with a fastener (39*b*), such as a screw or a rivet.

In some embodiments, at least one long edge of the shield (31) is proximate to the base plate (32). In some embodiments, both the first (35) and second long edges (36) of the shield (31) are proximate to the first (37) and second long edges (38) of the base plate (32), respectively. In some embodiments, the first long edge of the shield (35) is bent in a 'U' shape to accept the debossed first long edge of the base plate (37). The first long edge of the shield (35) is proximate to both the top and bottom of the debossed first long edge (37) of the base plate (32).

In some embodiments, the fastener (39*a*) used to attach the base plate (32) to a gutter cover (10) is below the heat cable (33) and passes through the base plate (32).

In some embodiments, a fastener (39*b*) is used to attach both the shield (31) and the base plate (32) to the gutter cover (10).

The term arcuate surface (13) means a surface that forms an arc. The arc may be created by one or more curves with different radii of curvature. The arc may be formed by more than one chord of a circle made with a discrete bend or bends in the surface to create the chords. The arc may be formed by a combination of one or more curves and one or more chords.

For convenience the terms front and forward refer to parts that are further from the roof when it is installed on a gutter. The terms back and rear refer to parts that are closer from the roof when it is installed on a gutter.

The term contiguous means that one surface is in contact with another surface.

The heat cable (22) heats the gutter cover to melt ice or snow. The heat cable (22) increases the temperature of the gutter cover (10) so that the gutter cover (10) is at a high enough temperature to melt ice or snow. In some embodiments the heat cable (22) is a low temperature self-regulating cable, such as the CHROMALOX brand self-regulating low temperature heating cable, available from www.chromalox.com. It is capable of being directly connected to typical household electric service. It is self regulating so that when the ambient temperature is higher less heat is produced, and when the ambient temperature is lower more heat is produced. It may be jacketed to protect it from exposure to water and the environment. The heat cable (22) can provide enough heat at cold ambient temperatures to melt ice and snow.

The heat cable (22) is attached to an electrical source. The heat cable (22) may be placed inside the downspout and through an opening near the bottom of the downspout to connect to an electrical outlet or hardwired into an electrical circuit. The opening in the downspout may be sealed to prevent rainwater from leaking out. In some embodiments the heat cable (22) may be inserted through the end of a gutter cover, into the attic of a house, and connected to an electrical outlet or hardwired into an electrical circuit. In some embodiments the heat cable (22) may be placed in or near a roof valley to melt ice or snow near the roof valley.

In some embodiments the heat cable (22) is controlled by a manual or automatic switch or a temperature measuring device that automatically controls a switch. In addition, a switch may be used to manually turn on and off the heat cable. A temperature measuring device may be used to turn on the heat cable when the temperature is below a set temperature.

The gutter cover heater is able to melt ice and snow from the gutter cover. In some embodiments it is able to melt ice and snow from shingles that are resting on the gutter cover because enough heat is transferred from the heat cable through the gutter cover to the shingles. By melting ice and snow from the gutter cover and shingles, the gutter cover heater reduces the likelihood of ice dams and damage caused by ice dams. When the gutter cover heater is installed with heat cable in the gutter and downspout, the melted ice and snow is able to drain away without refreezing in the gutter or downspout.

While the present disclosure has illustrated by description several embodiments and while the illustrative embodiments have been described in considerable detail, it is not the intention of the applicant to restrict or in any way limit the scope of the appended claims to such detail. Additional advantages and modifications may readily appear to those skilled in the art.

What is claimed is:

1. A gutter cover heater for a gutter cover, wherein the gutter cover heater comprises a shield, a base plate, and a heat cable;

wherein the shield is a longitudinally extended sheet that covers the heat cable, is curved over the heat cable, and has apertures, a first long edge, and a second long edge, wherein the apertures are on the curved portion of the shield above the heat cable;

wherein the base plate is a flat longitudinally extended sheet under the heat cable and the shield, with a first long edge and a second long edge; wherein the first long edge of the base plate is debossed;

wherein the first long edge of the shield wraps under the debossing of the first long edge of the base plate.

2. The gutter cover heater of claim 1, wherein at least one of the long edges of the shield is proximate to the base plate.

3. The gutter cover heater of claim 2, wherein the first and second long edges of the shield are proximate to the first and second long edges of the base plate, respectively.

4. The gutter cover heater of claim 1, wherein the first long edge of the shield is bent in a 'U' shape to accept the debossed first long edge of the base plate, wherein the first long edge of the shield is proximate to both the top and bottom of the debossed first long edge of the base plate.

5. The gutter cover heater of claim 1, wherein at least one screw or rivet attaches the base plate to a gutter cover, wherein the screw or rivet is below the heat cable.

6. The gutter cover heater of claim 1, wherein at least one screw or rivet attaches the base plate to a gutter cover, wherein the screw or rivet passes through the second long edge of both the shield and the base plate.

* * * * *